US009174430B2

(12) United States Patent
Kanayama et al.

(10) Patent No.: US 9,174,430 B2
(45) Date of Patent: Nov. 3, 2015

(54) NUMBERING AND IMPRINTING MACHINE

(71) Applicants: Tomoya Kanayama, Ibaraki (JP); Hiroshi Inoue, Ibaraki (JP)

(72) Inventors: Tomoya Kanayama, Ibaraki (JP); Hiroshi Inoue, Ibaraki (JP)

(73) Assignee: KOMORI CORPORATION, Tokyo (JP)

( * ) Notice: Subject to any disclaimer, the term of this patent is extended or adjusted under 35 U.S.C. 154(b) by 61 days.

(21) Appl. No.: 13/689,498

(22) Filed: Nov. 29, 2012

(65) Prior Publication Data

US 2013/0139709 A1 Jun. 6, 2013

(30) Foreign Application Priority Data

Dec. 1, 2011 (JP) ..... 2011/263417

(51) Int. Cl.

| | |
|---|---|
| ***B41F 13/00*** | (2006.01) |
| ***B41F 31/30*** | (2006.01) |
| ***B41F 33/00*** | (2006.01) |
| ***B41F 33/04*** | (2006.01) |
| ***B41F 33/10*** | (2006.01) |
| ***B41F 33/14*** | (2006.01) |

(52) U.S. Cl.

CPC ..... *B41F 13/0032* (2013.01); *B41F 13/0024* (2013.01); *B41F 31/302* (2013.01); *B41F 33/0018* (2013.01); *B41F 33/0036* (2013.01); *B41F 33/045* (2013.01); *B41F 33/10* (2013.01); *B41F 33/14* (2013.01); *B41P 2233/20* (2013.01)

(58) Field of Classification Search

CPC .... B41F 13/0032; B41F 13/42; B41F 31/302; B41F 33/0018; B41F 33/14; B41F 13/0024; B41F 33/10; B41F 33/045; B41P 2233/20

USPC ..... 101/76, 183, 349.1, 216, 152, 136, 141

See application file for complete search history.

(56) References Cited

U.S. PATENT DOCUMENTS

| | | | | |
|---|---|---|---|---|
| 4,222,325 | A * | 9/1980 | Edwards | 101/137 |
| 5,025,726 | A * | 6/1991 | Funabashi et al. | 101/352.05 |
| 5,142,979 | A | 9/1992 | Funada et al. | |
| 6,408,141 | B1 * | 6/2002 | Tahara | 399/12 |
| 2009/0095178 | A1 * | 4/2009 | Schwitzky et al. | 101/139 |
| 2010/0294149 | A1 * | 11/2010 | Kusaka | 101/153 |

FOREIGN PATENT DOCUMENTS

| | | | |
|---|---|---|---|
| CN | 1564747 | A | 1/2005 |
| CN | 101316710 | A | 11/2006 |
| CN | 101890832 | A | 11/2010 |
| EP | 0 444 227 | A1 | 9/1991 |
| EP | 1 088 657 | A1 | 4/2001 |
| EP | 1790474 | | 5/2007 |

(Continued)

*Primary Examiner* — Blake A Tankersley

(74) *Attorney, Agent, or Firm* — Blakely Sokoloff Taylor & Zafman LLP

(57) ABSTRACT

This invention discloses a numbering and imprinting machine including an impression cylinder, a stamp cylinder, a first printing cylinder, a second printing cylinder, and a moving inker which includes a first ink supply device and second ink supply device. A first space is formed between the moving inker, which is set at a retraction position, and the first and second printing cylinders so as to permit entrance of the operator into it. A second space is formed between the stamp cylinder and the first printing cylinder to permit the operator who has entered the first space to access the impression cylinder.

6 Claims, 6 Drawing Sheets

(56) References Cited

FOREIGN PATENT DOCUMENTS

| | | | |
|---|---|---|---|
| EP | 2253468 | | 11/2010 |
| EP | 2 338 682 | A1 | 6/2011 |
| JP | 2000-301688 | A | 10/2000 |
| WO | WO 03/047862 | A1 | 6/2003 |
| WO | WO 2007/060624 | A1 | 5/2007 |
| WO | WO 2011/145028 | | 11/2011 |

* cited by examiner

NUMBERING AND IMPRINTING MACHINE

BACKGROUND OF THE INVENTION

The present invention relates to a numbering and imprinting machine which prints a number on a sheet.

A numbering and imprinting machine of this type includes a feed unit, printing unit, and delivery unit, as disclosed in Japanese Patent Laid-Open No. 2000-301688. The feed unit feeds a sheet. The printing unit includes a stamp cylinder and number cylinder arranged around an impression cylinder which holds and conveys the sheet fed from the supply unit. The delivery unit delivers the sheet having the stamp and number printed on it by the stamp cylinder and number cylinder, respectively.

In the conventional numbering and imprinting machine as described above, a top sheet for supporting the sheet is mounted on the circumferential surface of the impression cylinder, so it is necessary to perform an impression cylinder maintenance operation including an operation of cleaning or replacing the top sheet.

The conventional printing machine as described above is provided with a stamp cylinder and number cylinder arranged around the impression cylinder, and an ink supply device including a plurality of rollers in one-to-one correspondence with the stamp cylinder and number cylinder. For this reason, it is difficult for the operator (maintenance personnel) to access the impression cylinder, so he or she must enter the gap in one of a pair of frames of the printing unit in the maintenance operation of the impression cylinder.

In this case, after the operator accesses one end of the impression cylinder, he or she must move to the opposite printing machine frame to access the opposite side of the impression cylinder. Alternatively, two operators must perform each maintenance operation individually for one end and the other end of the impression cylinder, so the workability of the maintenance operation is poor.

SUMMARY OF THE INVENTION

It is an object of the present invention to propose a numbering and imprinting machine which attains a greatly higher workability for the maintenance operation of an impression cylinder.

In order to achieve the above-mentioned object, a numbering and imprinting machine according to the present invention comprises an impression cylinder which holds and conveys a sheet, a stamp cylinder which is disposed in contact with the impression cylinder, and prints a stamp on the sheet held by the impression cylinder, a first printing cylinder which is disposed downstream of a printing position of the stamp cylinder in a direction in which the sheet is conveyed, and in contact with the impression cylinder, and performs first printing on the sheet held by the impression cylinder, a second printing cylinder which is disposed downstream of a printing position of the first printing cylinder in the direction in which the sheet is conveyed, and in contact with the impression cylinder, and performs second printing on the sheet held by the impression cylinder, at least one of the first printing and the second printing including number printing, and a moving inker including a first ink supply device which supplies first ink onto the first printing cylinder, and a second ink supply device which supplies second ink onto the second printing cylinder, the moving inker being movable between an actuation position at which the first ink supply device and the second ink supply device supply the first ink and the second ink, respectively, onto the first printing cylinder and the second printing cylinder, respectively, and a retraction position at which the first ink supply device and the second ink supply device separate from the first printing cylinder and the second printing cylinder, respectively, wherein a first space is formed between the moving inker, which is set at the retraction position, and the first and second printing cylinders so as to permit entrance of an operator thereinto, and a second space is formed between the stamp cylinder and the first printing cylinder to permit the operator who has entered the first space to access the impression cylinder.

According to an aspect of the present invention, the operator can access the impression cylinder very easily, so it is possible to remarkably improve the workability of the maintenance operation.

According to another aspect of the present invention, the operator can easily perform a maintenance operation regardless of the height at which the first printing cylinder or second printing cylinder is disposed.

According to still another aspect of the present invention, in the maintenance operation of the impression cylinder, the operator can lean against the support member, so it is possible to improve the workability of the maintenance operation and considerably reduce his or her physical burden.

DESCRIPTION OF THE PREFERRED EMBODIMENT

A numbering and imprinting machine according to the present invention will be described in detail below with reference to the accompanying drawings.

Figure 1:
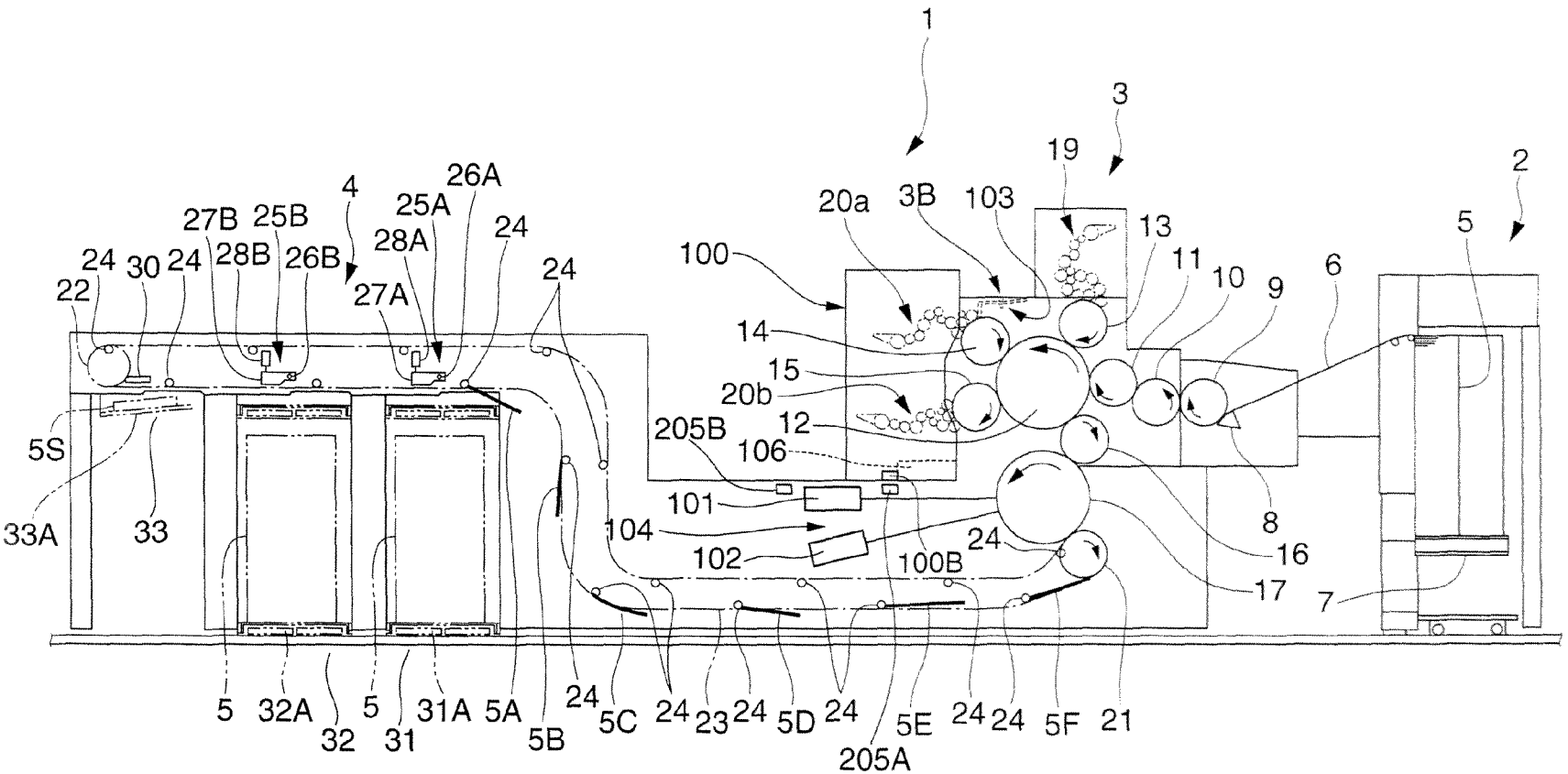
FIG. 1 is a side view showing the entire arrangement of a numbering and imprinting machine.
Figure 2:
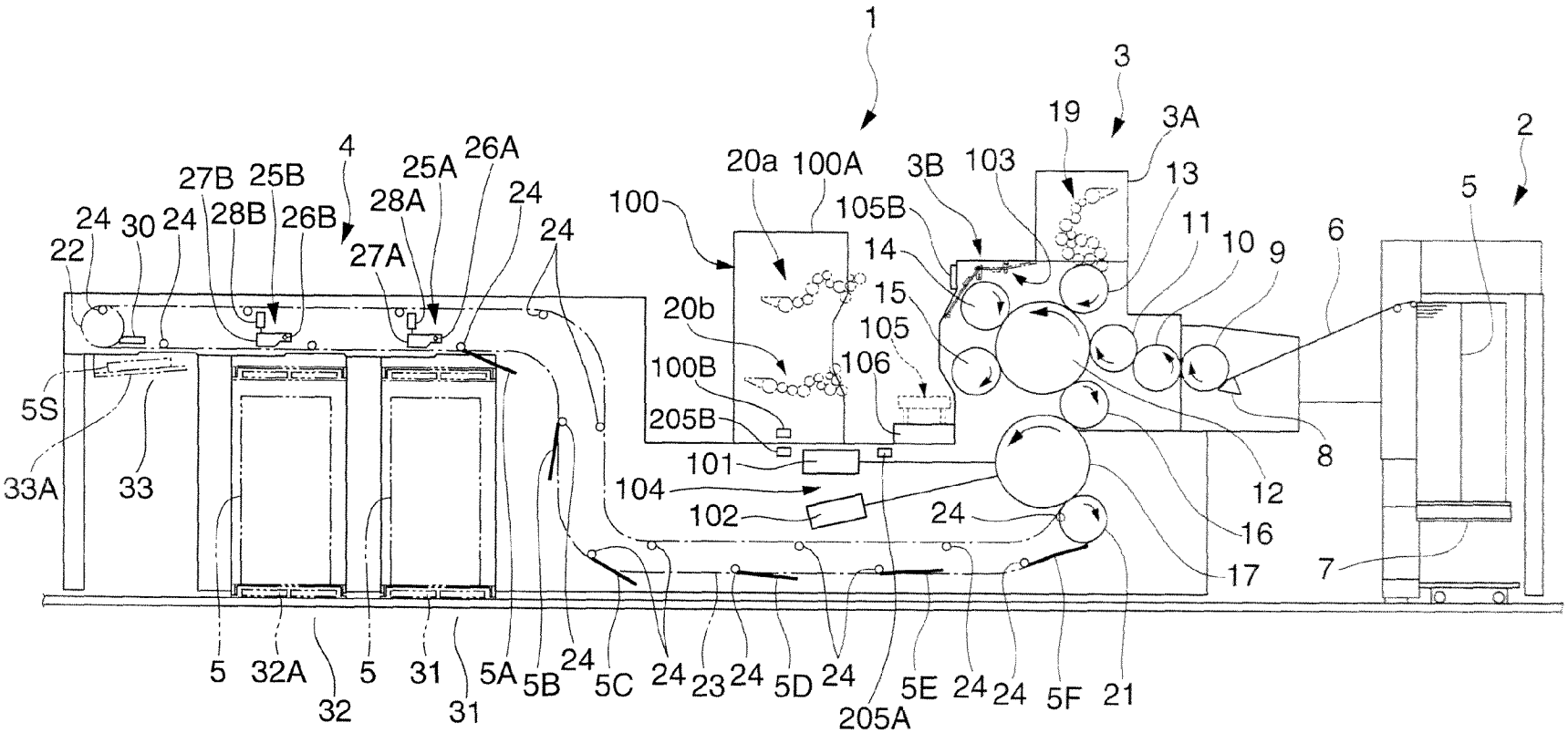
FIG. 2 is a side view showing the state of the numbering and imprinting machine when a moving inker shown in FIG. 1 has moved to a retraction position.

A numbering and imprinting machine according to an embodiment of the present invention will be described with reference to FIGS. 1 to 5. Referring to FIG. 1, a numbering and imprinting machine 1 includes a feed unit 2 which feeds sheets 5 to a feeder board 6 one by one, a printing unit 3 which prints stamps and numbers on the sheets 5 fed from the feed unit 2, and a delivery unit 4 which delivers the sheets 5 printed by the printing unit 3.

The feed unit 2 includes a pile board 7 which stacks a large number of sheets 5 having images printed on them by another printing machine. The feed unit 2 includes a sucker device (not shown) which feeds the sheets 5 on the pile board 7 one by one, and the feeder board 6 which conveys the sheets 5 fed from the sucker device. The distal end of the feeder board 6 is provided with a swing arm shaft pregripper 8 which receives and conveys the sheets 5 from the feeder board 6.

A transfer cylinder 9 is disposed downstream of the swing arm shaft pregripper 8 in the direction in which the sheet 5 is conveyed. The transfer cylinder 9 is rotatably supported by a frame 3A and holds and conveys the sheet 5. A transfer cylinder 10 is disposed in contact with the transfer cylinder 9.

The transfer cylinder 10 is rotatably supported by the frame 3A and holds and conveys the sheet 5. A transfer cylinder 11 is disposed in contact with the transfer cylinder 10. The transfer cylinder 11 is rotatably supported by the frame 3A and holds and conveys the sheet 5. An impression cylinder 12 is disposed in contact with the transfer cylinder 11. The impression cylinder 12 is rotatably supported by the frame 3A and holds and conveys the sheet 5.

A stamp cylinder 13 is disposed downstream of the transfer cylinder 11 in the direction in which the impression cylinder 12 rotates, and in contact with the impression cylinder 12. The stamp cylinder 13 is rotatably supported by the frame 3A and prints a stamp on the sheet 5. A number cylinder (first printing cylinder) 14 is disposed downstream of the stamp cylinder 13 in the direction in which the impression cylinder 12 rotates, and in contact with the impression cylinder 12. The number cylinder 14 is rotatably supported by the frame 3A and prints a number on the sheet 5. The stamp cylinder 13 is arranged obliquely above the impression cylinder 12 on the upstream ide in the direction in which the sheet 5 is conveyed, while the number cylinder 14 is arranged obliquely above the impression cylinder 12 on the downstream side in the direction in which the sheet 5 is conveyed. A number cylinder (second printing cylinder) 15 is disposed downstream of the number cylinder 14 in the direction in which the impression cylinder 12 rotates, and in contact with the impression cylinder 12. The number cylinder 15 is rotatably supported by the frame 3A and prints a number on the sheet 5. The number cylinder 15 is arranged obliquely below the impression cylinder 12 on the upstream side in which the sheet 5 is conveyed. A transfer cylinder 16 is disposed downstream of the number cylinder 15 in the direction in which the impression cylinder 12 rotates, and in contact with the impression cylinder 12. The transfer cylinder 16 is rotatably supported by the frame 3A and holds and conveys the sheet 5 received from the impression cylinder 12.

The frame 3A is provided with an ink supply device 19 including an ink fountain and a roller group which transfers ink from the ink fountain to supply the ink onto the stamp cylinder 13. The impression cylinder 12, stamp cylinder 13, number cylinders 14 and 15, and ink supply device 19 constitute a main body printing unit 3B.

The printing unit 3 includes the main body printing unit 3B and a moving inker 100 which includes a pair of ink supply devices 20*a* and 20*b*. The moving inker 100 is supported to be movable between an actuation position (FIG. 1) at which it comes close to the main body printing unit 3B, and a separation position (FIG. 2) at which it separates from the main body printing unit 3B. At the actuation position, the ink supply devices 20*a* and 20*b* come into contact with the number cylinders 14 and 15, respectively. At the separation position, the ink supply devices 20*a* and 20*b* separate from the number cylinders 14 and 15, respectively, and the moving inker 100, in turn, separates from the main body printing unit 3B so as to leave a space SPC1 (to be described later) between them.

The ink supply devices 20*a* and 20*b* include an ink fountain and a roller group which supplies ink transferred from the ink fountain to the number cylinders 14 and 15, respectively. The ink supply devices 20*a* and 20*b* are supported by a frame 100A of the moving inker 100, and move integrally with the moving inker 100 as the moving inker 100 moves to the actuation position and separation position. Inker position detectors 205A and 205B which detect the position of the moving inker 100 are set at the actuation position and separation position, respectively, on the frame 3A. The inker position detectors 205A and 205B are implemented by proximity sensors which detect that an object to be detected 100B attached to the frame 100A of the moving inker 100 has come in close proximity to them.

An inspection cylinder 17 is disposed in contact with the transfer cylinder 16. The inspection cylinder 17 is pivotally supported by the frame 3A and holds and conveys the sheet 5. A pair of inspection cameras 101 and 102 are supported by the frame 3A to be opposed to the circumferential surface of the inspection cylinder 17. The inspection cameras 101 and 102 inspect the qualities of the stamps and numbers (for example, the printing positions or printing densities of the stamps and numbers) printed on the sheets 5 which are wound around the circumferential surface of the inspection cylinder 17 and conveyed. One of the inspection cameras 101 and 102 detects the position or density of the number printed on the sheet 5 using ultraviolet curing ink (UV ink), while the other detects the position or density of the number printed on the sheet 5 using normal ink. The inspection cylinder 17 and inspection cameras 101 and 102 constitute an inspection unit 104. The impression cylinder 12 of the printing unit 3 is connected to the inspection cylinder 17 of the inspection unit 104 via the transfer cylinder 16 alone.

A delivery cylinder 21 is disposed in contact with, the inspection cylinder 17. The delivery cylinder 21 is pivotally supported by the frame 3A. A pair of delivery chains 23 are looped around a sprocket (not shown) coaxial with the delivery cylinder 21 and a sprocket 22 disposed at the terminal end of the delivery unit 4.

A plurality of gripper bars 24 are arranged between the pair of delivery chains 23 with predetermined gaps between them. The gripper bars 24 hold the sheet 5. The gripper bars 24 convey the sheet 5 as the delivery chains 23 travel to selectively deliver it onto a first delivery pile 31, a second delivery pile 32, or a third delivery pile 33. The first delivery pile 31 includes a pile board 31A for stacking sheets 5. The second delivery pile 32 including a pile board 32A for stacking sheets 5 is disposed downstream of the first delivery pile 31 in the direction in which the sheet 5 is conveyed. The third delivery pile 33 including a receptacle 33A for stacking sheets 5 is disposed downstream of the second delivery pile 32 in the direction in which the sheet 5 is conveyed. A fit sheet 5 inspected by the inspection camera 101 or 102 is delivered onto the first delivery pile 31 or 32, while an unfit sheet 5 inspected by the inspection camera 101 or 102 is delivered onto the third delivery pile 33. The delivery piles 31, 32, and 33 constitute a sheet stacking unit.

A delivery cam device 25A is supported by the frame 3A at a position above the first delivery pile 31. The delivery cam device 25A serves as a switching device and includes a delivery cam 27A which is pivotally supported about a shaft 26A as a pivot center, and an air cylinder 28A which moves the delivery cam 27A to a delivery position and retraction position. At the delivery position, the delivery cam 27A extends to the traveling path of the cam follower of the gripper bars 24 to cancel holding of the sheet 5 by the gripper bars 24. At the retraction position, the delivery cam 27A retracts from the traveling path of the gripper bars 24.

A delivery cam device 25B is supported by the frame 3A at a position above the second delivery pile 32. The delivery cam device 25B includes a delivery cam 27B which is pivotally supported about a shaft 26B as a pivot center, and an air cylinder 28B serving as a switching device which moves the delivery cam 27B to a delivery position and retraction position.

A fixing cam 30 is fixed to the frame 3A at a position above the third delivery pile 33 to face the traveling path of the cam follower of the gripper bars 24. The delivery cylinder 21, sprocket 22, delivery chains 23, gripper bars 24, sheet stacking unit, and delivery cam devices 25A, 25B and fixing cam 30 constitute the delivery unit 4.

Figure 3:
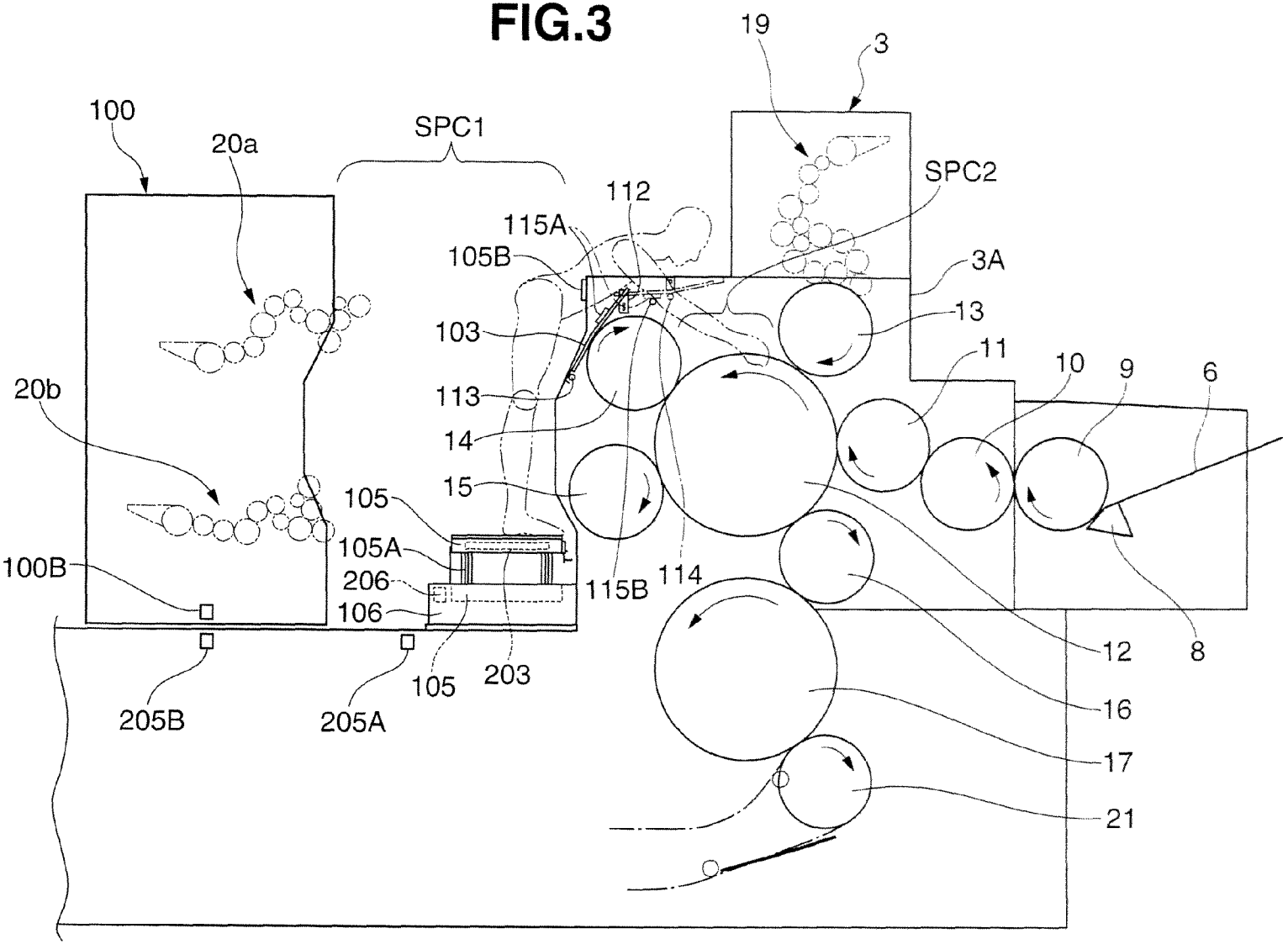
FIG. 3 is a side view for explaining a maintenance operation by the operator in a printing unit shown in FIG. 2.

As shown in FIG. 3, when the moving inker 100 is set at the retraction position, a first space SPC1 is formed between the moving inker 100 and the main body printing unit 3B of the printing unit 3, that is, between the moving inker 100 and the vertically aligned number cylinders 14 and 15 to have a width which allows the operator to enter it and perform a maintenance operation.

A second space SPC2 is formed at a position above the impression cylinder 12 between the stamp cylinder 13 and the number cylinder 14 to have a width which allows the operator to insert his or her hand into it and perform a maintenance operation for the impression cylinder 12. That is, the number cylinder 14 is disposed between the region of the first space SPC1 and the region of the second space SPC2 formed to extend in the direction in which the sheet 5 is conveyed.

A step 106 is formed between the main body printing unit 3B and the moving inker 100 set at the retraction position. The step 106 is exposed to the first space SPC1 when the moving inker 100 is set at the retraction position. The step 106 is provided with a lifter 105 liftably supported by legs 105A. The lifter 105 includes an internal pressure sensor 203 serving as an object detector which detects the presence of the operator as he or she gets on it. The frame 3A is provided with a lift switch 105B which raises and lowers the lifter 105. The step 106 is provided with a lifter position detection device 206 which detects that the upper surface of the lifter 105 is set at an initial position flush with the upper surface of the step 106, as indicated by a broken line in FIG. 3.

A hinge portion 112 is attached to the frame 3A at a position above the number cylinder 14, and a thin plate-shaped support member (or bearing member) 103 is pivotally supported about the hinge portion 112 as a center. The support member 103 is disposed between the first space SPC1 and the number cylinder 14 and second space SPC2, and its position is selectively switched between the side of the first space SPC1 and number cylinder 14 and the side of the second space SPC2. That is, the support member 103 is supported to be swingable between a shielding position (bearing position) at which it covers the number cylinder 14 upon switching to the side of the first space SPC1, and a space closing position (non-bearing position) at which it closes the second space SPC2 upon switching to the side of the second space SPC2. At the space closing position, the support member 103 covers the number cylinder 14 from above, and opens the number cylinder 14 to the first space SPC1.

A cylindrical stay rod 113 is fixed to the frame 3A at a position below the hinge portion 112 on the side of the first space SPC1. The stay rod 113 locks the support member 103 to the shielding position as the distal end of the support member 103 abuts against it. A cylindrical stay rod 114 is fixed to the frame 3A at a position above the number cylinder 14. The stay rod 114 locks the support member 103 to the space closing position as the support member 103 abuts against it.

A magnet 115A is attached to the outer central portion of the support member 103, and a magnetic sensor 115B which detects the magnetism of the magnet 115A is attached to the frame 3A in the vicinity of the number cylinder 14. The magnet 115A and magnetic sensor 115B constitute a support member detector 115 which detects whether the support member 103 is set at the space closing position.

Figure 4:
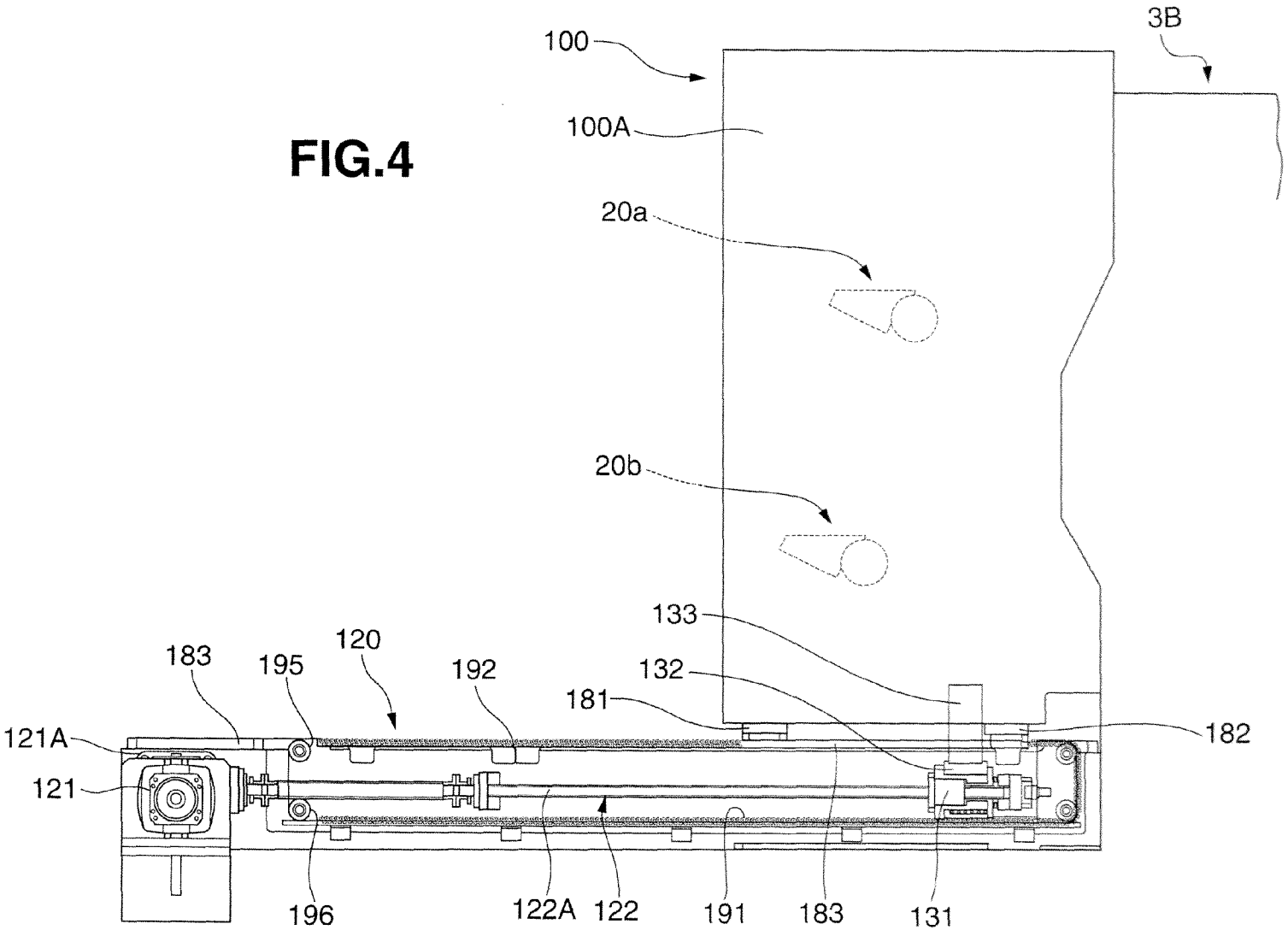
FIG. 4 is a side view of a moving inker moving device which drives the moving inker shown in FIG. 1.
Figure 5:
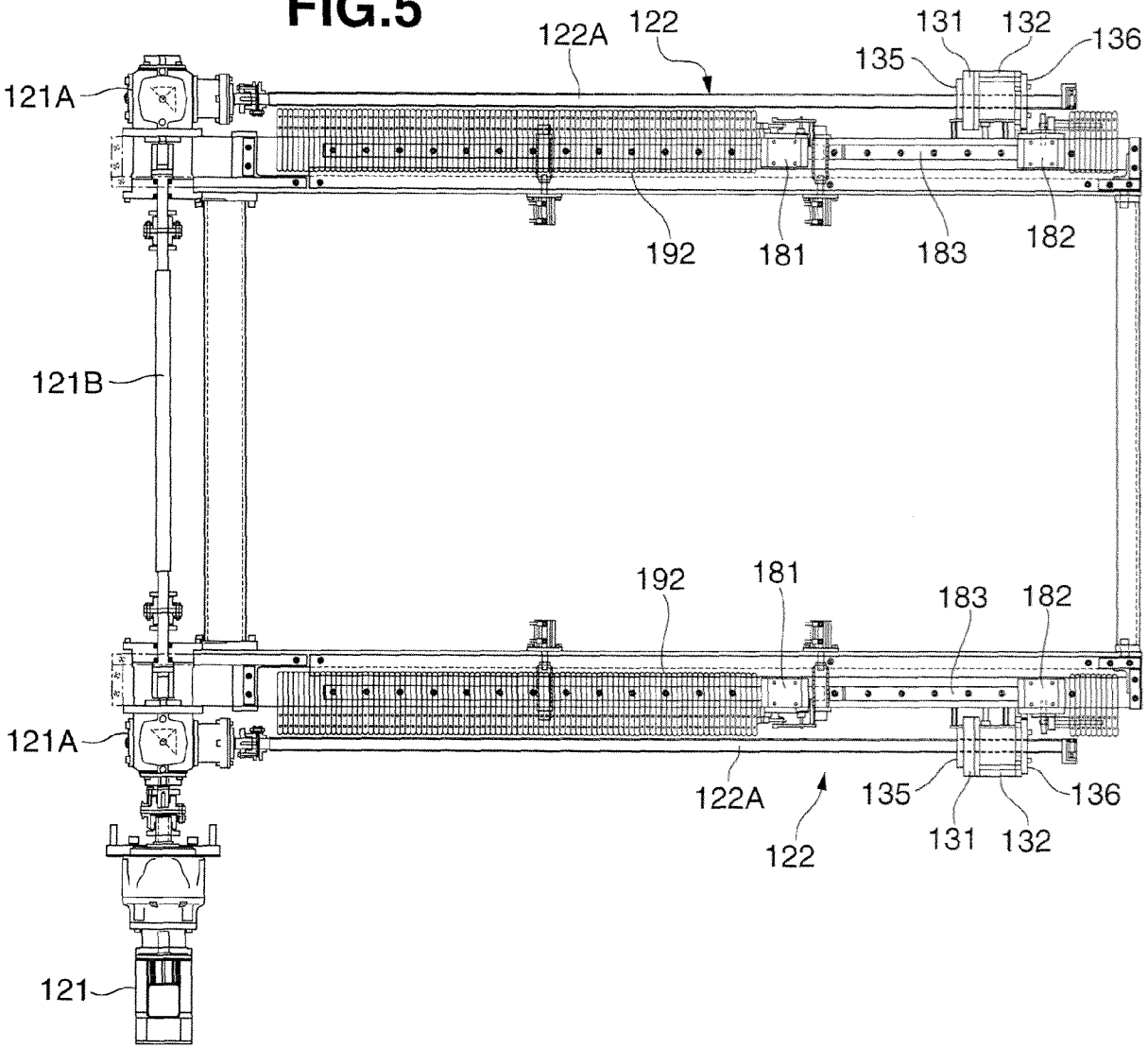
FIG. 5 is a top view of the inker moving device shown in FIG. 4.

The numbering and imprinting machine 1 is provided with an inker moving device 120 which reciprocally moves the moving inker 100 to the actuation position and separation position, as shown in FIGS. 4 and 5. A pair of guide rails 183 are attached to a pair of frames 3A, respectively, to extend in the frame longitudinal direction, that is, in a direction coming close to or away from the main body printing unit 3B. Movable elements 181 and 182 fixed to the lower end of the frame 100A of the moving inker 100 movably engage with the pair of guide rails 183. The guide rails 183 and movable elements 181 and 182 constitute an inker guide device.

A pair of screw shafts 122 are pivotally supported by the pair of frames 3A to have a longitudinal direction toward the main body printing unit 3B. The pair of screw shafts 122 are connected to and driven by a motor 121 supported by one of the frames 3A via a coupling 121A and a connecting shaft 121B, as shown in FIG. 5.

A nut 131 threadably engages with threaded portions 122A of the pair of screw shafts 122, respectively, and the threaded portions 122A and nut 131 form a ball screw. The nut 131 is supported by a connecting holder 132, which is supported by a holder 133 fixed to the frame 100A of the moving inker 100.

A chain 191 disposed laterally next to the guide rails 183 has its one end fixed to the movable element 181 and its other end fixed to the movable element 182, as shown in FIG. 4. The chain 191 is looped around four sprockets 193 to 196 rotatably supported by the frame 3A. The chain 191 is provided with a rail cover 192 formed by juxtaposing a large number of elongated plate-shaped bars which extend toward the guide rails 183 and cover the upper surfaces of the guide rails 183. The motor 121, coupling 121A, connecting shaft 121B, screw shafts 122, and nut 131 constitute the inker moving device 120.

Figure 6:
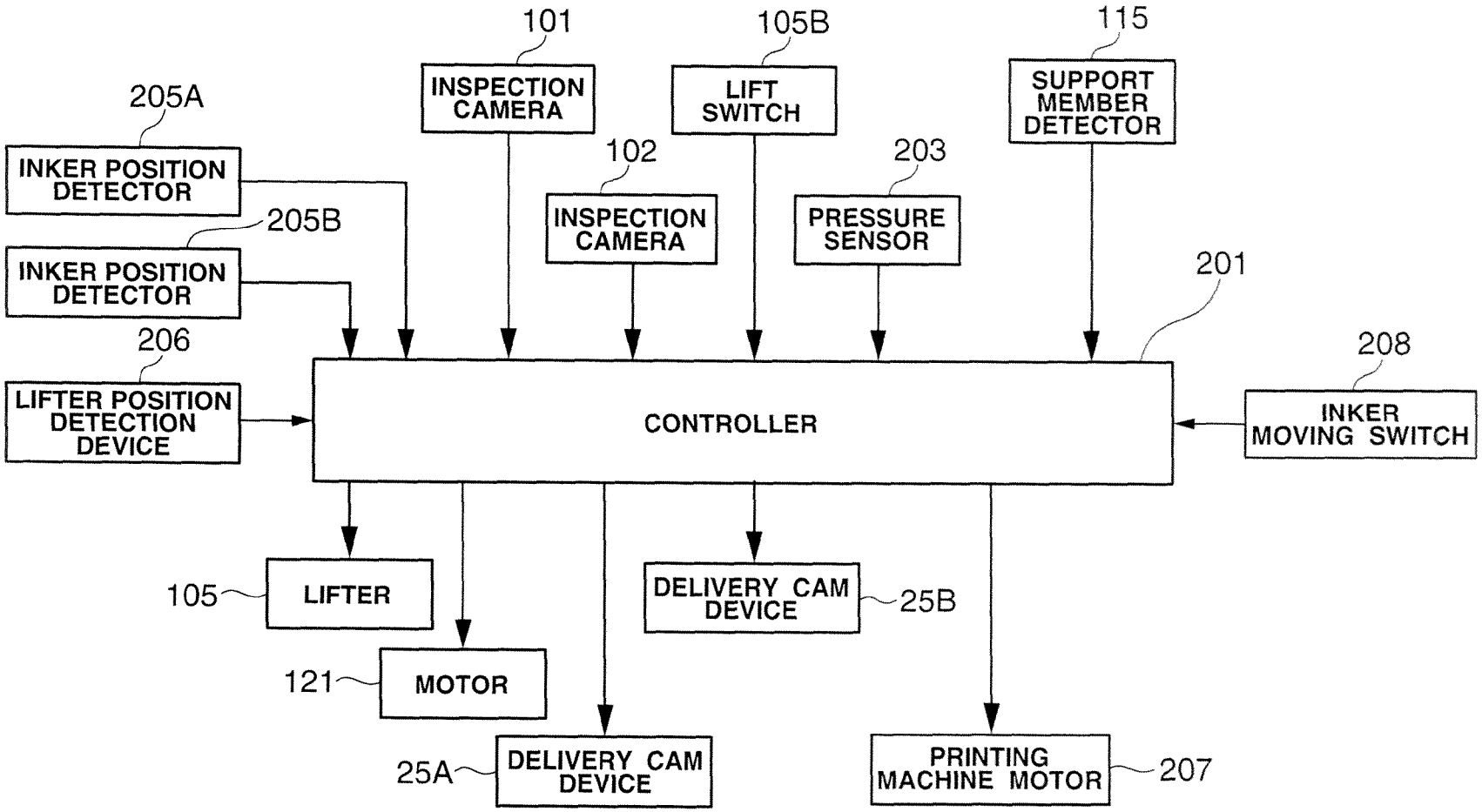
FIG. 6 is a block diagram showing the circuit configuration of the moving inker device.

The controller 201 is connected to the delivery cam devices 25A and 25B, inspection cameras 101 and 102, lifter 105, lift switch 105B, support member detector 115, inker driving motor 121, pressure sensor 203, inker position detectors 205A and 205B, lifter position detection device 206, and printing machine motor 207, as shown in FIG. 6. The controller 201 performs various types of control of the delivery cam device 25A, lifter 105, inker driving motor 121, inker position detectors 205A and 205B, and printing machine motor 207 based on the outputs from the inspection cameras 101 and 102, lift switch 105B, support member detector 115, pressure sensor 203, inker position detectors 205A and 205B, and lifter position detection device 206.

The operation of the numbering and imprinting machine 1 configured as mentioned above will be described next.

In printing on a sheet 5, first, the moving inker 100 is set at the actuation position shown in FIG. 1. At this time, the actuation position detector 205A detects the object to be detected 100B attached to the frame 100A of the moving inker 100 to, in turn, detect that the moving inker 100 is set at the actuation position. With this operation, the controller 201 sets the numbering and imprinting machine 1 in a print ready state. Then, a large number of sheets 5 having images already printed on them by another printing press are stacked on the pile board 7 of the feed unit 2.

When the numbering and imprinting machine 1 starts upon the operation of a start switch (not shown), the printing machine motor 207 is controlled to drive the numbering and imprinting machine 1 at a normal operating speed. At the same time, the sheets 5 stacked on the pile board 7 are fed onto the feeder board 6 one by one by the sucker device (not shown), and conveyed to the swing arm shaft pregripper 8 by the feeder board 6. The swing arm shaft pregripper 8 receives the sheet 5 from the feeder board 6 and performs a swing operation to transfer the sheet 5 onto the transfer cylinder 9.

The sheet 5 held by the transfer cylinder 9 is conveyed onto the impression cylinder 12 via the transfer cylinders 10 and 11.

The sheet 5 conveyed onto the impression cylinder 12 is further conveyed and passes between the stamp cylinder 13 and the impression cylinder 12 with rotation of the impression cylinder 12. When the sheet 5 passes between the stamp cylinder 13 and the impression cylinder 12, it undergoes stamp printing by the stamp cylinder 13 onto which ink is transferred from the ink fountain of the ink supply device 19 via the roller group. With rotation of the impression cylinder 12, the sheet 5 passes between the number cylinder 14 and the impression cylinder 12, and further passes between the number cylinder 15 and the impression cylinder 12. When the sheet 5 passes between the number cylinder 14 and the impression cylinder 12, it undergoes first number printing by the number cylinder 14 onto which ink is transferred from the ink fountain of the ink supply device 20*a* via the roller group. When the sheet 5 passes between the number cylinder 15 and the impression cylinder 12, it undergoes second number printing by the number cylinder 15 onto which ink is transferred from the ink fountain of the ink supply device 20*b* via the roller group.

The sheet 5 is transferred onto the inspection cylinder 17 via the transfer cylinder 16 with rotation of the impression cylinder 12. The sheet 5 transferred onto the inspection cylinder 17 is conveyed while its printing surface on which a stamp and two types of numbers are printed faces outwards, and an image of the printing surface of the sheet 5 is captured by the inspection camera 101 or 102. The controller 201 receives the image capture data from the inspection camera 101 or 102 to determine the qualities of the stamp printing result and number printing result of the sheet 5. In this manner, since the impression cylinder 12 of the printing unit 3 is connected to the inspection cylinder 17 of the inspection unit 104 via the transfer cylinder 16 alone, the printing quality of the sheet 5 can be inspected immediately after printing. This makes it possible to detect a printing failure early, thus decreasing the rate of generation of unfit printing sheets.

The sheet 5 having its printing surface inspected by the inspection camera 101 or 102 is transferred from the inspection cylinder 17 to the gripper bars 24, and then conveyed to the sheet stacking unit as the delivery chains 23 travel. If the controller 201 determines that the sheet 5 is fit, it actuates the air cylinder 28A of the delivery cam device 25A to set the delivery cam 27A at the delivery position. With this operation, the fit sheet 5 held and conveyed by the gripper bars 24 is delivered onto the first delivery pile 31 as the cam follower of the gripper bars 24 engages with the delivery cam 27A to cancel holding of this sheet 5 by the gripper bars 24.

When the number of fit sheets 5 delivered onto the first delivery pile 31 reaches a predetermined count, the controller 201 controls the delivery cam devices 25A and 25B so as to deliver fit sheets 5 to the second delivery pile 32 in the succeeding stage. That is, the controller 201 controls the delivery cam device 25A to set the delivery cam 27A at the retraction position, and actuates the air cylinder 28B of the delivery cam device 25B to set the delivery cam 27B at the delivery position. With this operation, the fit sheet 5 is delivered onto the second delivery pile 32 as the cam follower of the gripper bars 24 passes without engaging with the delivery cam 27A, and engages with the delivery cam 27B. The operator pulls out the first delivery pile 31 to set an empty pile board 31A in it while fit sheets 5 are delivered onto the second delivery pile 32. When the number of fit sheets 5 on the second delivery pile 32 reaches a predetermined count as well, the controller 201 controls the delivery cam device 25A to switch the delivery destination so as to deliver fit sheets 5 onto the first delivery pile 31.

On the other hand, if the controller 201 determines that the sheet 5 is unfit, it controls the delivery cam devices 25A and 250 to set the delivery cams 27A and 270, respectively, at the retraction positions. With this operation, the cam follower of the gripper bars 24 passes without engaging with the delivery cams 27A and 27B, and engages with the fixing cam 30. Hence, the unfit sheet 5 held and conveyed by the gripper bars 24 is delivered onto the third delivery pile 33.

The maintenance operation of the printing unit 3 or moving inker 100 of the numbering and imprinting machine 1 will be described next. First, the moving inker 100 moves to a retraction position shown in FIG. 2 upon the retraction operation of an inker moving switch 208. When the moving inker 100 is set at the retraction position, the inker position detector 205B detects the object to be detected 100B of the moving inker 100. Upon this operation, the controller 201 determines that the moving inker 100 is set at the retraction position, and controls the numbering and imprinting machine 1 to a print unready state.

When the moving inker 100 moves to the retraction position, a first space SPC1 is formed between the main body printing unit 3B and the moving inker 100. Hence, the operator enters the first space SPC1 to perform a maintenance operation for the main body printing unit 3B including the number cylinder 14 or a maintenance operation for the moving inker 100. In this manner, the operator can perform a maintenance operation in the first space SPC1 formed as the moving inker 100 moves to the retraction position, so it is possible to improve the workability of the maintenance operation and considerably reduce his or her physical burden.

In the maintenance operation of the number cylinder 14, which includes top sheet replacement, the support member 103 is set at a shielding position indicated by a solid line in FIG. 3. As the position of the support member 103 is switched from the space closing position to the shielding position, the second space SPC2 between the number cylinder 14 and the stamp cylinder 13 opens. At this time, the magnetic sensor 115B does not detect the magnet 115A of the support member 103 to allow the controller 201 to recognize that the support member 103 is set at the shielding position.

In such a state, the operator enters the first space SPC1, gets on the step 106, and then accesses the impression cylinder 12 via the second space SPC2. At this time, since a pressure is applied to the pressure sensor 203 due to the weight of the operator, the controller 201 detects the presence of the operator based on the output from the pressure sensor 203. The controller 201 controls the motor 121 of the inker moving device 120 so as to inhibit movement of the moving inker 100 set at the retraction position, when the magnetic sensor 115B does not detect the magnet 115A of the support member 103 (when the support member 103 is set at the shielding position), and a pressure equal to or higher than a predetermined pressure is applied to the pressure sensor 203 (when the operator stands on the step 106).

The operator performs a maintenance operation, which includes cleaning or replacement of the top sheet mounted on the circumferential surface of the impression cylinder 12, via the second space SPC2 while he or she stays in the first space SPC1 upon entrance. Since the operator can perform a specific series of operations while he or she stays in the gap between the pair of frames 3A, he or she can easily access the central portion and two end portions of the impression cylinder 12, thereby allowing an efficient maintenance operation.

Also, when the operator staying in the first space SPC1 performs a maintenance operation for the impression cylinder 12 via the second space SPC2, he or she does so while bending forward, that is, toward the impression cylinder 12, as shown in FIG. 3. In this case, the operator can lean against the support member 103 set at the shielding position, so it is possible to considerably reduce his or her physical burden.

Moreover, the number cylinder (first printing cylinder) 14 is shielded from the first space SPC1 by the support member 103 set at the shielding position. Therefore, in the maintenance operation of the impression cylinder 12, the support member 103 protects the operator so as not to directly touch the number cylinder 14. It is therefore possible to prevent the number cylinder 14 from being contaminated or damaged.

Note that when the number cylinder 14 is set at a higher position, the operator operates the lift switch 105B to raise the lifter 105. This allows the operator to select a position at which he or she can perform a specific series of operations in a natural posture, thus significantly reducing his or her physical burden.

After the end of the maintenance operation, the support member 103 is set at a space closing position indicated by an alternate long and two short dashed line in FIG. 3. At this time, the controller 201 recognizes that the position of the support member 103 has switched from the shielding position to the space closing position, based on the detection output of the magnet 115A from the magnetic sensor 115B. When the support member 103 is set at the space closing position, the number cylinder 14 opens to the first space SPC1, and the portion above the second space SPC2 between the number cylinder 14 and the stamp cylinder 13 is closed. This inhibits the operator who has entered the first space SPC1 from accessing the impression cylinder 12 to prevent any foreign substances from entering the numbering and imprinting machine 1 via the second space SPC2. It is therefore possible to prevent the impression cylinder 12 from being contaminated or damaged.

Next, when the lifter 105 descends and returns to the initial position upon the operation of the lift switch 105B by the operator, the lifter position detection device 206 detects that the lifter 105 is set at the initial position. When the operator gets down from the lifter 105 and exits the region of the first space SPC1, the controller 201 confirms that the operator is absent in the first space SPC1, based on the output from the pressure sensor 203.

The controller 201 controls movement of the moving inker 100 based on the detection outputs of the magnetic sensor 115B, pressure sensor 203, and lifter position detection device 206. That is, the controller 201 permits movement of the moving inker 100 from the retraction position to the actuation, position only when all of the following three conditions are satisfied while the moving inker 100 is set at the retraction position:

- the magnetic sensor 1150 detects the magnet 115A (the support member 103 is absent at the shielding position),
- the pressure sensor 203 does not detect application of a pressure equal to or higher than a predetermined pressure (the operator is absent on the step 106), and
- the lifter position detection device 206 detects a return of the lifter 105 to the initial position.

This means that only when those three conditions are satisfied, the controller 201 controls the motor 121 of the inker moving device 120 to move the moving inker 100 from the separation position to the actuation position upon the return operation of the inker moving switch 208. On the other hand, when even one of the three conditions is not satisfied, the controller 201 inhibits movement of the moving inker 100 even if the operator performs the return operation of the inker moving switch 208 by mistake.

In this manner, when the support member 103 is set at the shielding position, or the lifter 105 has ascended from the initial position, the controller 201 controls the moving inker 100 to inhibit its movement. This makes it possible to prevent the moving inker 100 from coming into contact with the ink supply device 20*a* and support member 103 and with the ink supply device 20*b* and lifter 105, and, in turn, to prevent these constituent components from being damaged.

Also, while the operator stays in the first space SPC1, the controller 201 controls the moving inker 100 to inhibit its movement. This makes it possible to prevent accidents in which the operator gets stuck in the gap between the moving inker 100 and the printing unit 3.

Upon the return operation of the inker moving switch 208, the motor 121 of the inker moving device 120 is driven to move the moving inker 100 to the actuation position. As the moving inker 100 is set at the actuation position, the inker position detector 205A detects the object to be detected 100B of the moving inker 100. With this operation, the controller 201 sets the numbering and imprinting machine 1 in a print ready state.

When the moving inker 100 is set at the actuation position, the controller 201 controls the lifter 105 to inhibit its lifting or lowering operation as the operator erroneously operates the lift switch 105B. This makes it possible to prevent the moving joker 100 from coming into contact with the ink supply device 20*b* and lifter 105, and, in turn, to prevent these devices from being damaged.

In an aspect of the above-mentioned embodiment, first number printing and second number printing are performed on the sheet 5 using the number cylinder 14 serving as a first printing cylinder and the number cylinder 15 serving as a second printing cylinder, respectively. However, the present invention is not limited to this case, and one of the first and second printing cylinders may serve as a number cylinder, while the other may serve as a printing cylinder other than a number cylinder.

In another aspect of the above-mentioned embodiment, the support member detector 115 includes the magnet 115A attached to the support member 103, and the magnetic sensor 115B serving as a support member detection sensor attached to the frame 3A. However, the present invention is not limited to this case, and the magnetic sensor 115B serving as a support member detection sensor may be set on the side of the support member 103, while the magnet 115A may be set on the side of the frame 3A. Also, the position of the support member 103 may be detected from the pivot angle of the support member 103 using an angle sensor.

In still another aspect of the present invention, the pressure sensor 203 detects the operator on the step 106. However, the same applies to the case wherein an object such as a maintenance bag owned by the operator is detected instead of himself or herself. Also, although the operator on the step 106 is detected using the pressure sensor 203, a contact sensor which detects that the operator keeps his or her feet on the upper surface of the step 106 may be employed. Moreover, the presence of an object including the operator may be detected using a photoelectric conversion element.

In still another aspect of the above-mentioned embodiment, a ball screw mechanism is used as the inker moving device 120 to move the moving inker 100. However, the present invention is not limited to this case, and a driving device such as an oil hydraulic cylinder or rodless cylinder may be used to move the moving inker 100. Also, a proximity sensor is used as the moving inker position detector 205A which detects the position of the moving inker 100. However, the present invention is not limited to this case, and the position of the moving inker 100 may be detected by counting the rotation speed (for example, rotation pulses from a rotary encoder) of the motor 121 or screw shafts 122. Note that when a driving device such as an oil hydraulic cylinder or rodless cylinder is used as the inker moving device 120, a potentiometer or a sensor built into the oil hydraulic cylinder or rodless cylinder may be used.

What is claimed is:

1. A numbering and imprinting machine comprising:

an impression cylinder which holds and conveys a sheet;

a stamp cylinder which is disposed in contact with said impression cylinder, and prints a stamp on the sheet held by said impression cylinder;

a first printing cylinder which is disposed downstream of a printing position of said stamp cylinder in a direction in which the sheet is conveyed, and in contact with said impression cylinder, and performs first printing on the sheet held by said impression cylinder;

a second printing cylinder which is disposed downstream of a printing position of said first printing cylinder in the direction in which the sheet is conveyed, and in contact with said impression cylinder, and performs second printing on the sheet held by said impression cylinder, at least one of the first printing and the second printing including number printing; and a moving inker including a first ink supply device which supplies first ink onto said first printing cylinder, and a second ink supply device which supplies second ink onto said second printing cylinder, said moving inker being movable between an actuation position at which said first ink supply device and said second ink supply device supply the first ink and the second ink, respectively, onto said first printing cylinder and said second printing cylinder, respectively, and a retraction position at which said first ink supply device and said second ink supply device separate from said first printing cylinder and said second printing cylinder, respectively, wherein a first space is formed between said moving inker, which is set at the retraction position, and said first and second printing cylinders so as to permit entrance of an operator thereinto, and a second space is formed between said stamp cylinder and said first printing cylinder to permit the operator who has entered the first space to access said impression cylinder, the numbering and imprinting machine further comprising:

a plate-shaped support member which is supported to be switchable between a first position at which said support member covers said first printing cylinder against the first space and a second position at which said support member causes said first printing cylinder to be open to the first space, wherein said support member being positioned at the first position is configured to allow the operator who accesses said impression cylinder via the second space to lean onto said support member and to prevent the operator from contacting said first printing cylinder;

a support member detector which detects that said support member is positioned at the first position; and a controller which inhibits movement of said moving inker from the retraction position to the actuation position in response to a detection output of said support member detector.

2. A machine according to claim 1, further comprising:

a first inker position detector which detects that said moving inker is set at the actuation position;

a second inker position detector which detects that said moving inker is set at the retraction position;

wherein said controller which permits a printing operation in response to a detection output of said first inker position detector, and inhibits the printing operation in response to a detection output of said second inker position detector.

3. A machine according to claim 2, wherein said support member is arranged between the first space and said first printing cylinder, and is supported to be swingable between the first position and a space closing position at which said support member closes the second space.

4. A machine according to claim 3, further comprising:

a step which is arranged in a region of the first space, and on which the operator stands during an operation;

an object detector which detects an object including the operator on said step;

a lifter which lifts and lowers the operator on said step; and a lifter detector which detects that said lifter has returned to an initial position, wherein said controller permits movement of said moving inker from the retraction position to the actuation position only when all of three conditions are satisfied:

said support member detector has generated no detection output, said object detector has generated no detection output, and said lifter detector has generated a detection output.

5. A machine according to claim 2, further comprising:

a step which is arranged in a region of the first space, and on which the operator stands during an operation; and an object detector which detects an object including the operator on said step, wherein said controller inhibits movement of said moving inker from the retraction position to the actuation position in response to a detection output of said object detector.

6. A machine according to claim 2, further comprising:

a lifter which is arranged in a region of the first space, and lifts and lowers the operator; and a lifter detector which detects that said lifter has returned to an initial position, wherein said controller permits movement of said moving inker from the retraction position to the actuation position in response to a detection output of said lifter detector.

* * * * *